US008217849B2

(12) United States Patent
Sardariani et al.

(10) Patent No.: US 8,217,849 B2
(45) Date of Patent: Jul. 10, 2012

(54) SMALL PROFILE ANTENNA AND RFID DEVICE HAVING SAME

(75) Inventors: Edmond Sardariani, San Jose, CA (US); Sireesha Ramisetti, Sunnyvale, CA (US)

(73) Assignee: Intelleflex Corporation, Santa Clara, CA (US)

( * ) Notice: Subject to any disclaimer, the term of this patent is extended or adjusted under 35 U.S.C. 154(b) by 441 days.

(21) Appl. No.: 12/098,960

(22) Filed: Apr. 7, 2008

(65) Prior Publication Data

US 2010/0007570 A1 Jan. 14, 2010

(51) Int. Cl.
*H01Q 9/16* (2006.01)

(52) U.S. Cl. ..... 343/793; 343/895; 343/795

(58) Field of Classification Search ..... 343/700 MS, 343/895, 793, 795

See application file for complete search history.

(56) References Cited

U.S. PATENT DOCUMENTS

| | | | | |
|---|---|---|---|---|
| 5,521,610 | A * | 5/1996 | Rodal | 343/797 |
| 5,995,062 | A * | 11/1999 | Denney et al. | 343/853 |
| 6,433,742 | B1 * | 8/2002 | Crawford | 343/700 MS |
| 2002/0024468 | A1 * | 2/2002 | Palmer et al. | 343/702 |
| 2005/0242959 | A1 * | 11/2005 | Watanabe | 340/572.7 |
| 2006/0043199 | A1 * | 3/2006 | Baba et al. | 235/492 |

* cited by examiner

*Primary Examiner* — Hoanganh Le
(74) *Attorney, Agent, or Firm* — Zilka-Kotab, PC

(57) ABSTRACT

An antenna system for a Radio Frequency Identification (RFID) tag in one embodiment includes a base portion; at least one angled portion oriented to have a tangential angle of between about 1 degree and about 179 degrees from a plane of the base portion; and an antenna trace on the at least one angled portion. An antenna system for an RFID tag in another embodiment includes a base portion; at least one angled portion having at least two sections each oriented to have a tangential angle of between about 1 degree and about 179 degrees from a plane of the base portion, the two sections having different overall angles relative to the base portion; and an antenna trace on the at least one angled portion. Additional systems and methods are presented.

25 Claims, 6 Drawing Sheets

SMALL PROFILE ANTENNA AND RFID DEVICE HAVING SAME

FIELD OF THE INVENTION

The present invention relates to Radio Frequency (RF) antennas, and more particularly, this invention relates to dipole tag antennas and Radio Frequency Identification (RFID) devices having the same.

BACKGROUND OF THE INVENTION

The use of Radio Frequency Identification (RFID) tags are quickly gaining popularity for use in the monitoring and tracking of an item. RFID technology allows a user to remotely store and retrieve data in connection with an item utilizing a small, unobtrusive tag. As an RFID tag operates in the radio frequency (RF) portion of the electromagnetic spectrum, an electromagnetic or electrostatic coupling can occur between an RFID tag affixed to an item and an RFID tag reader. This coupling is advantageous, as it precludes the need for a direct contact or line of sight connection between the tag and the reader.

Dipole antennas are used in RFID devices currently. Dipole antennas typically include two conductive elements, e.g. wires, which are connected at an RF feed point in the middle, with the total length of the two conductive elements measuring all or a portion of one wavelength. The RF feed point acts as a node from which current flows, causing magnetic and electrical fields to develop. However, because the antenna radiating length typically extends linearly, the form factor for these antennas has generally been larger than desirable. Further, present antennas lie along a common plane, requiring a large form factor.

SUMMARY OF THE INVENTION

An antenna system for an RFID tag in one embodiment comprises a base portion; at least one angled portion oriented to have a tangential angle of between about 1 degree and about 179 degrees from a plane of the base portion; and an antenna trace on the at least one angled portion.

An RFID system (which includes an operational RFID system or a portion of an operational RFID system) according to another embodiment comprises a base portion; four angled portions each oriented to have a tangential angle of between about 1 degree and about 179 degrees from a plane of the base portion; and a dual dipole antenna having traces on each of the angled portions.

An antenna system for an RFID tag in a further embodiment comprises a base portion; at least one angled portion having at least two sections each oriented to have a tangential angle of between about 1 degree and about 179 degrees from a plane of the base portion, the two sections having different overall angles relative to the base portion; and an antenna trace on the at least one angled portion.

A method of fabricating an RFID system (which includes an operational RFID system or a portion of an operational RFID system) comprises inserting a substrate and antenna into a housing, the substrate having a base portion and at least one angled portion, the antenna being positioned, at least in part, on the at least one angled portion, wherein insertion of the substrate and antenna into the housing causes the at least one angled portion to become oriented to have a tangential angle of between about 5 degrees and about 175 degrees from a plane of the base portion.

Any of these embodiments may be implemented in a RFID system, which may include a RFID antenna and receiver device.

Other aspects, advantages and embodiments of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

DETAILED DESCRIPTION

Figure 1:
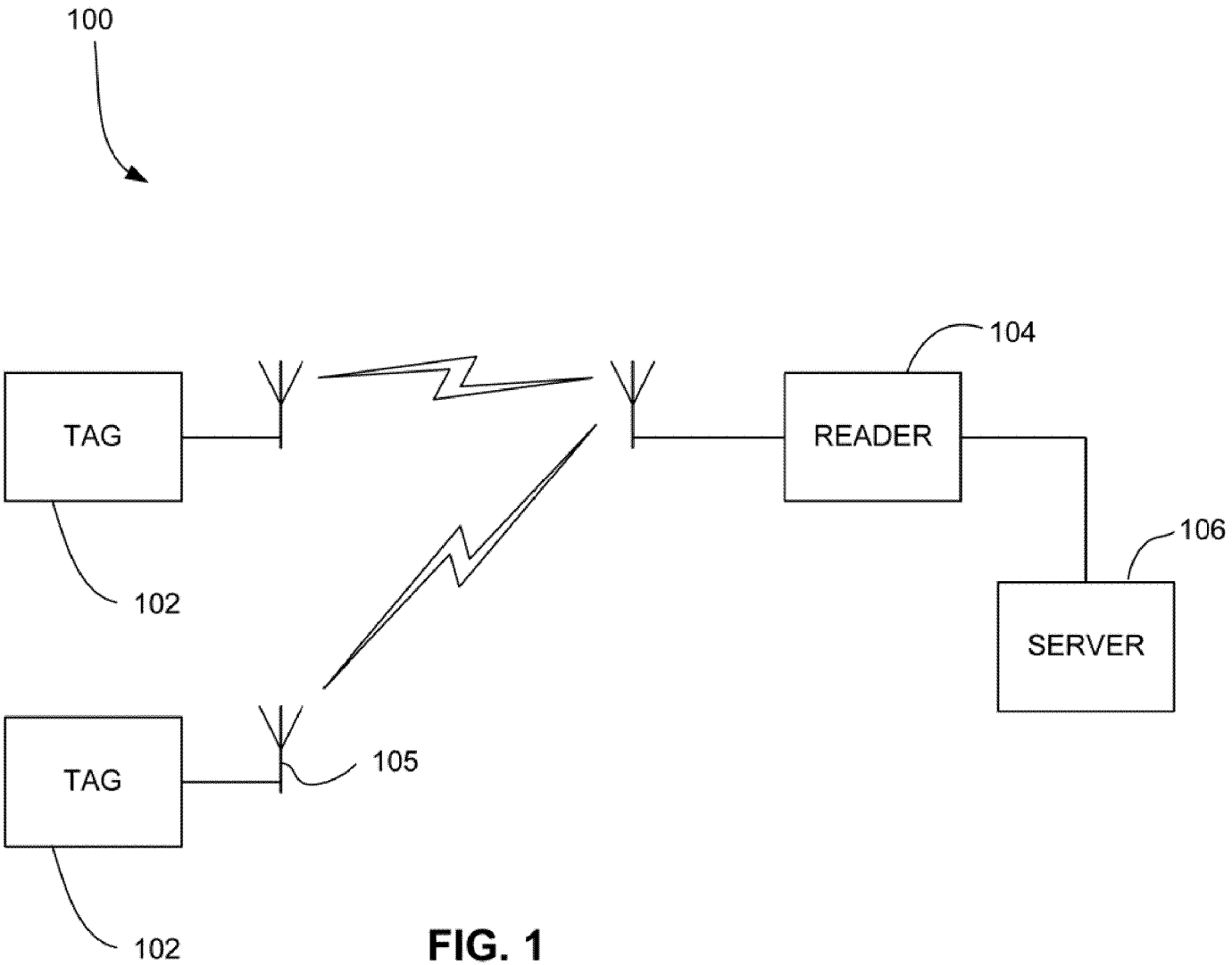
FIG. 1 is a system diagram of an RFID system.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In the drawings, like and equivalent elements are numbered the same throughout the various figures.

In one general embodiment, an antenna system for a Radio Frequency Identification (RFID) tag comprises a base portion and at least one angled portion oriented to have a tangential angle between about 1 degree and about 179 degrees from a plane of the base portion; and an antenna trace on the at least one angled portion. Note that in this and other embodiments, the angle can be in either direction relative to the plane of the base portion, e.g., in a positive or negative direction, such as between about ±1 and about ±179 degrees. The tangential angle in this and other embodiments can be measured from any plane or line tangential to the top or bottom side of the angled portion. For example, if the angled portion is planar, the tangential angle is generally along the plane of the angled portion. If the angled portion is arcuate, the tangential angle can be taken between a plane tangent to some point on the curved surface. If the angled portion includes a curved region and a planar region, the tangential angle can be taken between a plane tangent to some point on the curved surface or planar surface.

In another general embodiment, a RFID system comprises a base portion and four angled portions each oriented at an overall angle between about 1 degree and about 179 degrees from a plane of the base portion; and a dual dipole antenna having traces on each of the angled portions.

In another general embodiment, a method of fabricating a RFID system comprises inserting a substrate and antenna into a housing, the substrate having a base portion and at least one angled portion, the antenna being positioned, at least in part, on the at least one angled portion, wherein insertion of the substrate and antenna into the housing causes the at least one angled portion to become oriented at an overall angle of between about 5 degrees and about 175 degrees from a plane of the base portion.

In a further general embodiment, an antenna system for an RFID tag comprises a base portion; at least one angled portion having at least two sections each oriented to have a tangential angle of between about 1 degree and about 179 degrees from a plane of the base portion, the two sections having different overall angles relative to the base portion; and an antenna trace on the at least one angled portion.

FIG. 1 depicts an RFID system 100 according to one of the various embodiments, which may include some or all of the following components and/or other components. As shown in FIG. 1, one or more RFID devices 102 are present. Each RFID device 102 in this embodiment includes a controller and memory, which are preferably embodied on a single chip as described below, but may also or alternatively include a different type of controller, such as an application specific integrated circuit (ASIC), processor, an external memory module, etc. For purposes of the present discussion, the RFID devices 102 will be described as including a chip. Each RFID device 102 may further include or be coupled to an antenna 105.

An illustrative chip is disclosed below, though actual implementations may vary depending on how the device is to be used. In general terms, a preferred chip includes one or more of a power supply circuit to extract and regulate power from the RF reader signal; a detector to decode signals from the reader; a backscatter modulator, a transmitter to send data back to the reader; anti-collision protocol circuits; and at least enough memory to store its unique identification code, e.g., Electronic Product Code (EPC).

While RFID devices 102 according to some embodiments are functional RFID tags, other types of RFID devices 102 include merely a controller with on-board memory, a controller and external memory, etc.

Each of the RFID devices 102 may be coupled to an object or item, such as an article of manufacture, a container, a device, a person, etc.

With continued reference to FIG. 1, a remote device 104 such as an interrogator or "reader" communicates with the RFID devices 102 via an air interface, preferably using standard RFID protocols. An "air interface" refers to any type of wireless communications mechanism, such as the radio-frequency signal between the RFID device and the remote device. The RFID device 102 executes the computer commands that the RFID device 102 receives from the reader 104.

The system 100 may also include an optional backend system such as a server 106, which may include databases containing information and/or instructions relating to RFID tags and/or tagged items.

As noted above, each RFID device 102 may be associated with a unique identifier. Such identifier is preferably an EPC code. The EPC is a simple, compact identifier that uniquely identifies objects (items, cases, pallets, locations, etc.) in the supply chain. The EPC is built around a basic hierarchical idea that can be used to express a wide variety of different, existing numbering systems, like the EAN.UCC System Keys, UID, VIN, and other numbering systems. Like many current numbering schemes used in commerce, the EPC is divided into numbers that identify the manufacturer and product type. In addition, the EPC uses an extra set of digits, a serial number, to identify unique items. A typical EPC number contains:

1. Header, which identifies the length, type, structure, version and generation of EPC;
2. Manager Number, which identifies the company or company entity;
3. Object Class, similar to a stock keeping unit or SKU; and
4. Serial Number, which is the specific instance of the Object Class being tagged.

Additional fields may also be used as part of the EPC in order to properly encode and decode information from different numbering systems into their native (human-readable) forms.

Each RFID device 102 may also store information about the item to which coupled, including but not limited to a name or type of item, serial number of the item, date of manufacture, place of manufacture, owner identification, origin and/or destination information, expiration date, composition, information relating to or assigned by governmental agencies and regulations, etc. Furthermore, data relating to an item can be stored in one or more databases linked to the RFID tag. These databases do not reside on the tag, but rather are linked to the tag through a unique identifier(s) or reference key(s).

RFID systems may use reflected or "backscaLtered" radio frequency (RF) waves to transmit information from the RFID device 102 to the remote device 104, e.g., reader. Since passive (Class-1 and Class-2) tags get all of their power from the reader signal, the tags are only powered when in the beam of the reader 104.

The Auto ID Center EPC-Compliant tag classes are set forth below:

Class-1
Identity tags (RF user programmable, range ~3 m)
Lowest cost
Class-2
Memory tags (20 bit address space programmable at ~3 m range)
Security & privacy protection
Low cost
Class-3
Semi-passive tags (also called semi-active tags and battery assisted passive (BAP) tags)
Battery tags (256 bits to 2M words)
Self-Powered Backscatter (internal clock, sensor interface support)
~100 meter range
Moderate cost
Class-4
Active tags
Active transmission (permits tag-speaks-first operating modes)
~300 to ~1,000 meter range
Higher cost In RFID systems where passive receivers (i.e., Class-1 and Class-2 tags) are able to capture enough energy from the transmitted RF to power the device, no batteries are necessary. In systems where distance prevents powering a device in this manner, an alternative power source must be used. For these "alternate" systems (e.g., semi-active, semi-passive or battery-assisted), batteries are the most common form of power. This greatly increases read range, and the reliability of tag reads, because the tag does not need power from the reader to respond. Class-3 tags only need a 5 mV signal from the reader in comparison to the 500 mV that Class-1 and Class-2 tags typically need to operate. This 100:1 reduction in power requirement along with the reader's ability to sense a very small backscattered signal permits Class-3 tags to operate out to a free space distance of 100 meters or more compared with a Class-1 range of only about 3 meters. Note that semi-passive and active tags with built in passive mode may also operate in passive mode, using only energy captured from an incoming RF signal to operate and respond, at a shorter distance up to 3 meters.

Active, semi-passive and passive RFID tags may operate within various regions of the radio frequency spectrum. Low-frequency (30 KHz to 500 KHz) tags have low system costs and are limited to short reading ranges. Low frequency tags may be used in security access and animal identification applications for example. Ultra high-frequency (860 MHz to 960 MHz and 2.4 GHz to 2.5 GHz) tags offer increased read ranges and high reading speeds.

A basic RFID communication between an RFID device and a remote device typically begins with the remote device, e.g., reader, sending out signals via radio wave to find a particular RFID device, e.g., tag via singulation or any other method known in the art. The radio wave hits the RFID device, and the RFID device recognizes the remote device's signal and may respond thereto. Such response may include exiting a hibernation state, sending a reply, storing data, etc.

Figure 2:
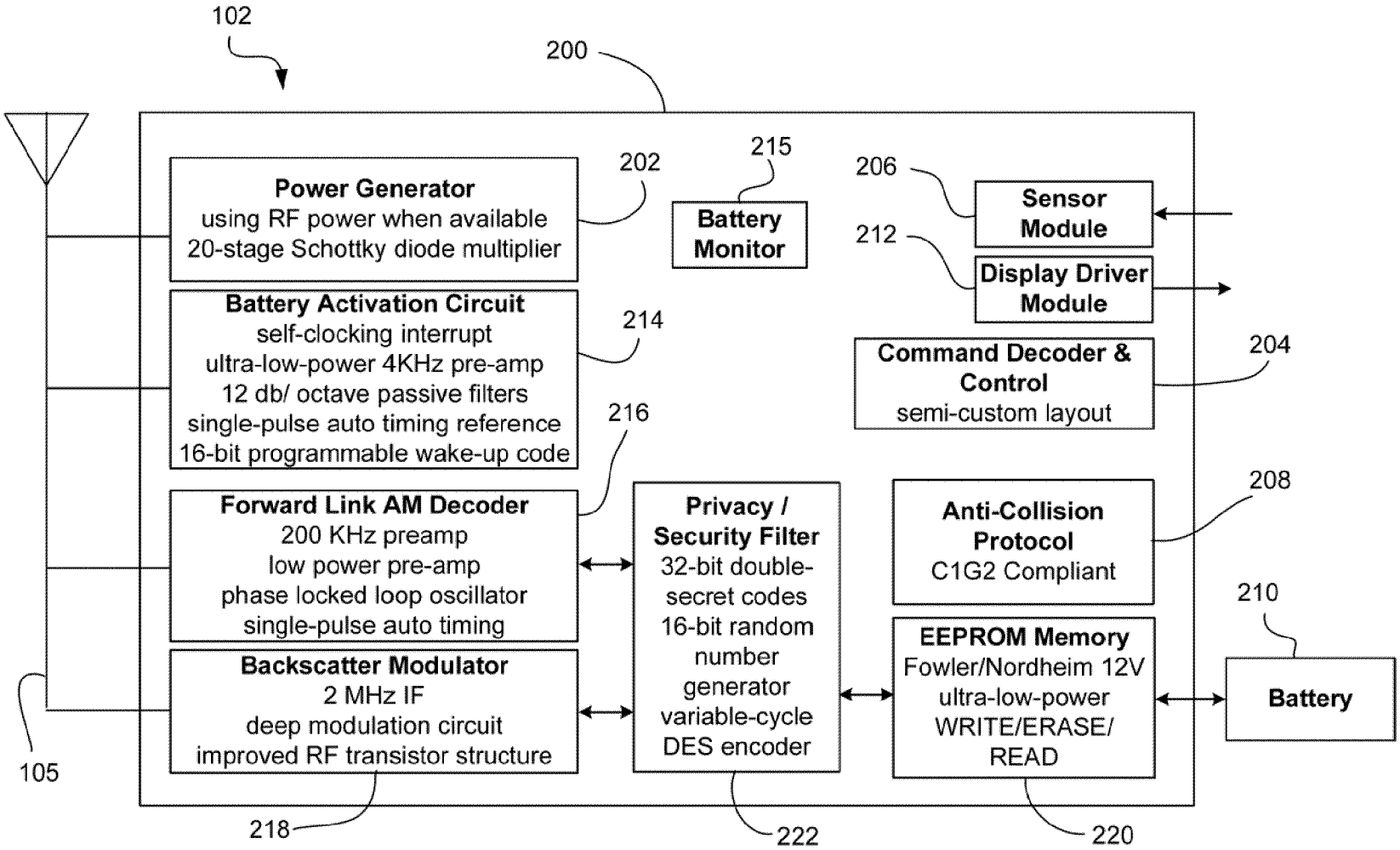
FIG. 2 is a system diagram for an integrated circuit (IC) chip for implementation in an RFID device.

Embodiments of the RFID device are preferably implemented in conjunction with a Class-3 or higher Class IC chip, which typically contains the processing and control circuitry for most if not all tag operations. FIG. 2 depicts a circuit layout of a Class-3 IC 200 and the various control circuitry according to an illustrative embodiment for implementation in an RFID tag 102. It should be kept in mind that the present invention can be implemented using any type of RFID device, and the circuit 200 is presented as only one possible implementation.

The Class-3 IC of FIG. 2 can form the core of RFID chips appropriate for many applications such as identification of pallets, cartons, containers, vehicles, or anything where a range of more than 2-3 meters is desired. As shown, the chip 200 includes several circuits including a power generation and regulation circuit 202, a digital command decoder and control circuit 204, a sensor interface module 206, a C1G2 interface protocol circuit 208, and a power source (battery) 210. A display driver module 212 can be added to drive a display.

A forward link AM decoder 216 uses a simplified phase-lock-loop oscillator that requires only a small amount of chip area. Preferably, the circuit 216 requires only a minimum string of reference pulses.

A backscatter modulator block 218 preferably increases the backscatter modulation depth to more than 50%.

A memory cell, e.g., EEPROM, is also present, and preferably has a capacity from several kilobytes to one megabyte or more. In one embodiment, a pure, Fowler-Nordheim direct-tunneling-through-oxide mechanism 220 is present to reduce both the WRITE and ERASE currents to about 2 μA/cell in the EEPROM memory array. Unlike any RFID tags built to date, this permits reliable tag operation at maximum range even when WRITE and ERASE operations are being performed. In other embodiments, the WRITE and ERASE currents may be higher or lower, depending on the type of memory used and its requirements.

Preferably, the amount of memory available on the chip or otherwise is adequate to store data such that the external device need not be in active communication with the remote device.

The module 200 may also incorporate a security encryption circuit 222 for operating under one or more security schemes, secret handshakes with readers, etc.

The RFID device may have a dedicated power supply, e.g. battery; may draw power from a power source of the electronic device (e.g., battery, AC adapter, etc.); or both. Further, the RFID device may include a supplemental power source. Note that while the present description refers to a "supplemental" power source, the supplemental power source may indeed be the sole device that captures energy from outside the tag, be it from solar, RF, kinetic, etc. energy.

Figure 3A:
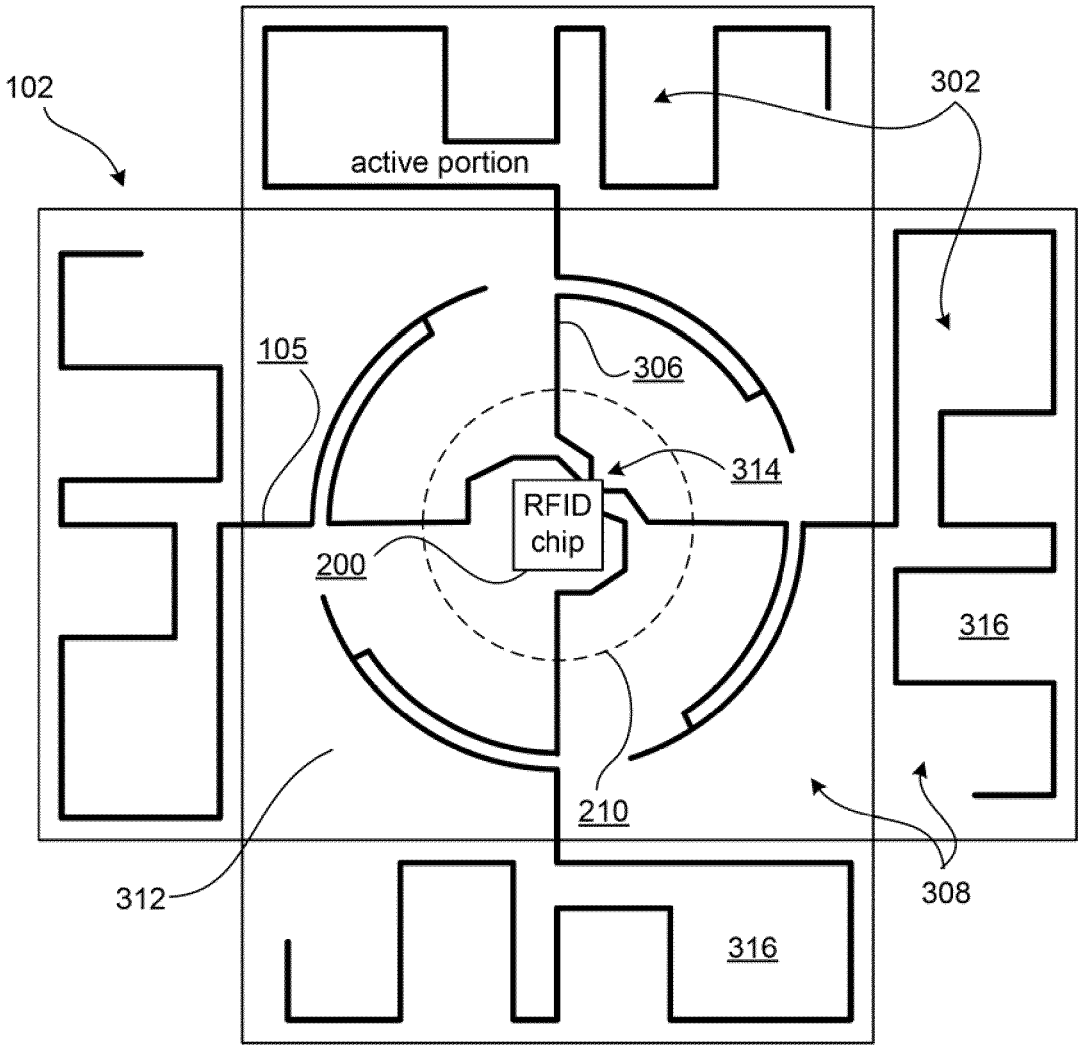
FIG. 3A is a top view of an RFID device according to a preferred embodiment.
Figure 3B:
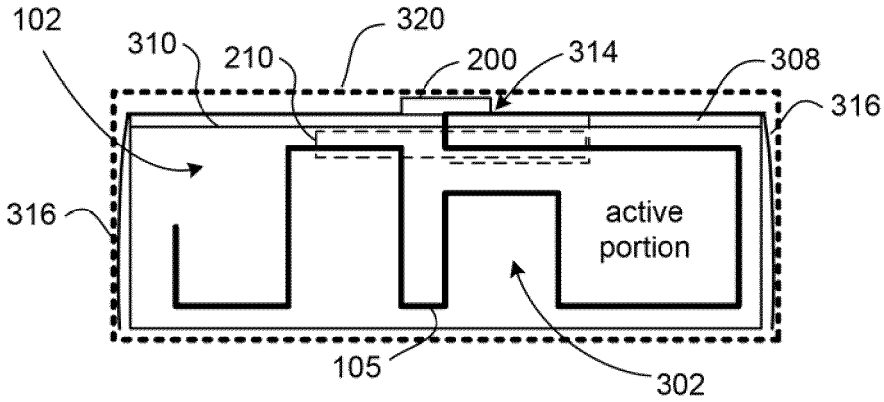
FIG. 3B is a side view of the RFID device in a housing according to a preferred embodiment.

FIGS. 3A and 3B depict a top and a side view, respectively, of a preferred embodiment of an RFID device 102. As shown, the RFID device 102 includes a dipole antenna 105 having a feed 306 coupled to the active portion 302. An RFID controller 200 is coupled to the feed 306. In operation, the controller 200 provides a signal to the feed, which excites the active portion 302, thereby generating an RF signal. This preferred embodiment has four angled portions 316 which extend from the base portion 312. Note that the angled portions and may be integral with the base portion, may be separate pieces coupled to the base portion, or a combination thereof. The active portion 302 of the antenna may be present on the angled portions 316, and in some approaches may be present, at least in part, on the base portion 312.

In FIG. 3B, the four angled portions 316 are shown folded down to minimize the form factor of the RFID antenna. Note that in this and other embodiments, the angled portions 316 may form a fold line at its junction of the base portion 312. In other approaches, the junction between the angled portions 316 and base portion 312 may simply be bent or curved, e.g., with no single fold line delineating the portions.

The active portion 302 may be formed on or in a substrate 308 such as a printed circuit board, flexible material (e.g., polymeric material), etc., and combinations thereof. For example, in various embodiments, the entire substrate may be flexible, while in other embodiments various portions may be rigid and other portions flexible. In further approaches, the entire substrate may be rigid.

The substrate 308 may also act as a support to other device components such as the controller 200. Further, the substrate 308 may support or contain the various circuitry and connections needed for proper operation of the device.

In one embodiment, the feed 306 is coplanar with the active portion 302. In one approach, the feed 306 may be coplanar to the active portion 302 for a full extent of the feed 306, i.e., from the coupling to the antenna portion to the lead connecting the feed 306 to the controller 200.

In this embodiment, the active portion 302 may or may not be on the same plane as the base portion 312 as shown in FIG. 3B, where the plane of the base portion 312 is an overall, or mean, plane. The active portion 302 of the antenna may be of standard construction known in the art. Typical materials that may be used to construct the active portion 302 are copper, gold, silver, aluminum, etc. In general, the overall length of each section of the dipole antenna may be approximately one-half wavelength at the resonant frequency, one-quarter wavelength at the resonant frequency, approximately one-eighth wavelength at the resonant frequency, approximately one-sixteenth wavelength at the resonant frequency, etc.

In one approach, the feed 306 is of continuous construction with the active portion 302. For example, the feed 306 may be formed concurrently with the active portion 302, e.g., by printing, deposition, etc. The feed 306 may thus be of the same material as the active portion 302. In other embodiments, the feed 306 may be formed in a different processing step than formation of the active portion 302 and/or of a different material than the active portion 302.

In embodiments where the RFID device is an active or semi-active device, a battery 210 or other power source may be coupled to the controller 200. In the embodiment shown, the battery is positioned on a plane located below the substrate 308, though other positions are possible. The substrate 308 may include a ground portion 310 for coupling to a terminal of a battery, e.g., via direct engagement thereof. As shown in FIG. 3B, the ground portion 310 is preferably connected to the substrate. Circuitry in the substrate 308, e.g., a conductive lead or via, may connect the ground portion 310 to the controller 200. Another lead may connect the other battery terminal to the controller 200. It should also be pointed out that the ground portion 310 can also serve any RF grounding needs.

One terminal of the battery, e.g., the negative terminal, may be in contact with the ground portion 310. For instance, a simple lead may be used to connect the ground portion 310 on the substrate 308 to the negative terminal of the battery.

Referring to FIG. 3B, in one embodiment, a housing 320 may be used to cause the substrate 308 to bend at the edge of the base portion 312 so that there is a fold at the junction of the base portion 312 and the angled portion 316. This may cause the active portions 302 of the dipole antenna to be on at least two separate planes than the base portion 312 plane. Each of the angled portions 316 of the substrate 308 may be folded at an angle of between about 1 degree and about 179 degrees from a plane of the base portion 312.

In this arrangement, and especially in the arrangement shown in FIG. 3B, it has been determined that, unpredictably, the dipole antenna has no full null in the radiation pattern. This is an advantage over planar dipole antennas because planar dipole antennas experience a full null when the antenna is on a plane perpendicular to the transmitting or receiving device. It has also been unexpectedly and unpredictably determined that the bandwidth of the antenna is not significantly compromised. This is contrary to what would be expected from small profile antennas.

Also, surprisingly, the present embodiment of the RFID device 102 experienced reducing detuning of the antenna when positioned near or against an RF reflective surface, as compared to a standard dipole antenna RFID device.

In another embodiment, there may be two, four, or six angled portions 316 of the substrate 308, with an antenna trace being present on each of the angled portions 316. The active portion 302 of the antenna may be a monopole or dipole antenna, and/or may be a folded dipole antenna. Further, the overall antenna system may include multiple monopole, dipole, and/or folded dipole antennas. Also, in any embodiment, at least one of the angled portions 316 may have a planar configuration, curved configuration, additional folds, and combinations thereof.

In another embodiment, the angled portion is oriented at an angle of between about 45 degrees and about 135 degrees from a plane of the base portion 312. In a further embodiment, the angled portion is oriented at an angle of between about 75 degrees and about 105 degrees from a plane of the base portion 312. In yet another embodiment, the angled portion is oriented at an angle of between about 85 degrees and about 95 degrees from a plane of the base portion 312.

In yet another embodiment, a profile of the substrate 308 has a width taken from any angle of less than about 3 inches; alternatively, less than about 2 inches, less than about 1.5 inches, less than about 1 inch, etc.

In a further embodiment, a portion of the active portion 302 of the antenna may be on the base portion 312 of the substrate 308. In such case, another part of the active portion 302 may be present on the angled portion 316. Such other part may be on the same antenna trace, or in another antenna trace.

In another embodiment, a portion of the angled portion 316 is folded at least once at a location away from a junction of the angled portion 316 and the base portion 312. For example, the angled portion 316 may be bent somewhere between the junction and its free end, thereby forming two or more sections oriented (overall) at angles to each other.

The design of the antenna is not narrowly critical. In one approach, the antenna may be designed to match an impedance of the controller 200. Particularly, the antenna may be matched to an arbitrary impedance, e.g., the impedance of an RFID chip to be used with the antenna. The required impedance bandwidth may be achieved by adjusting variables, such as the feedpoint 314, the width and/or length of the antenna 105 that connects the active portion 302 to the feed 306 (e.g., an impedance-matching portion of the antenna), the shape and/or dimensions of the active portion 302, etc. Computer modeling of antenna designs based on the teachings presented herein may be used to assist in selection of the feed 306 position, width of the antenna 105, and other variables for a particular implementation.

In another approach, the antenna 105 may be designed to an impedance of general use, e.g., 50 ohms, 75 ohms, 300 ohms, etc.

In embodiments that include a battery 210, the design should take into account the effects of the battery 210 on antenna performance. Again, computer modeling in conjunction with the teachings herein may be used to facilitate design.

Figure 4A:
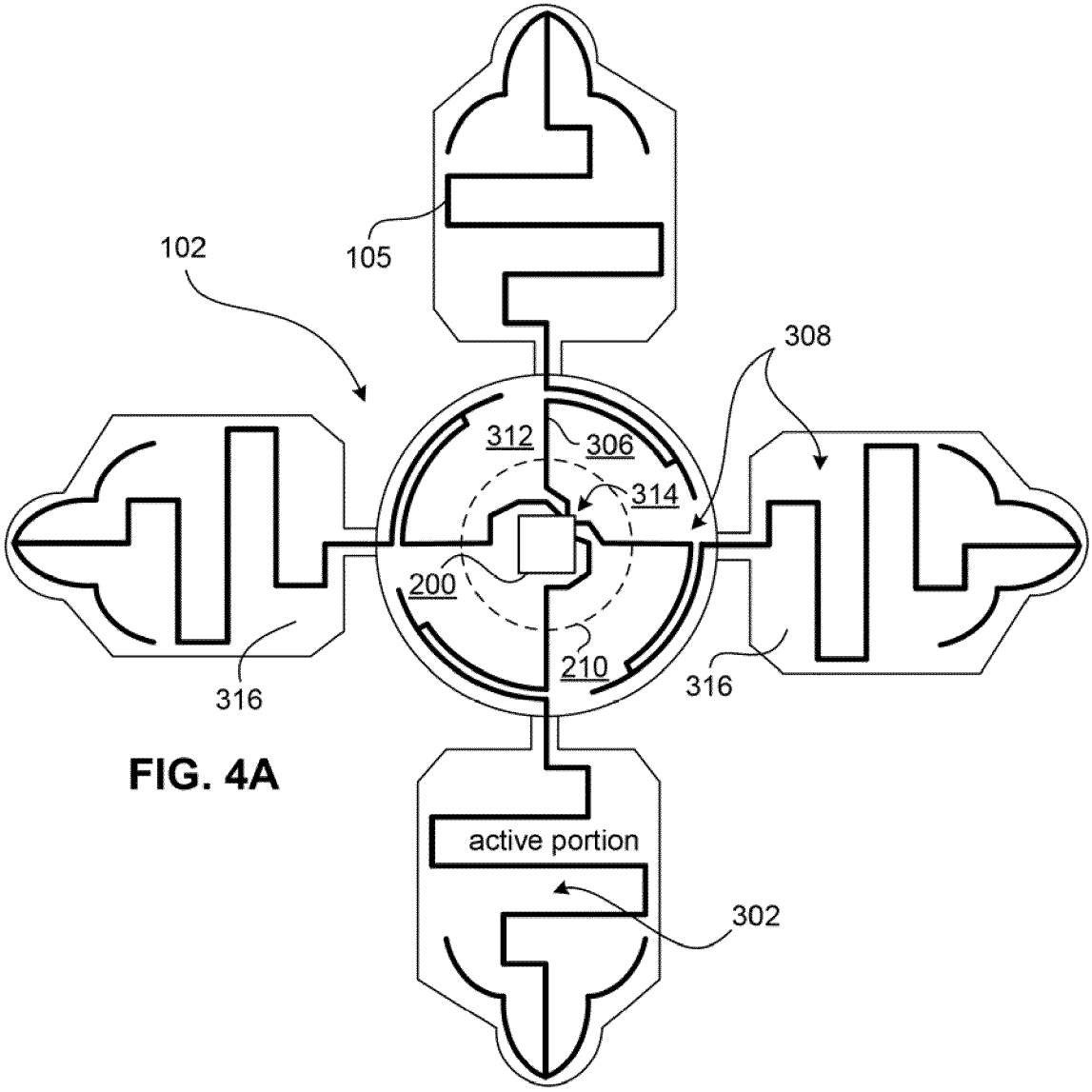
FIG. 4A is a top view of an RFID device according to one embodiment.
Figure 4B:
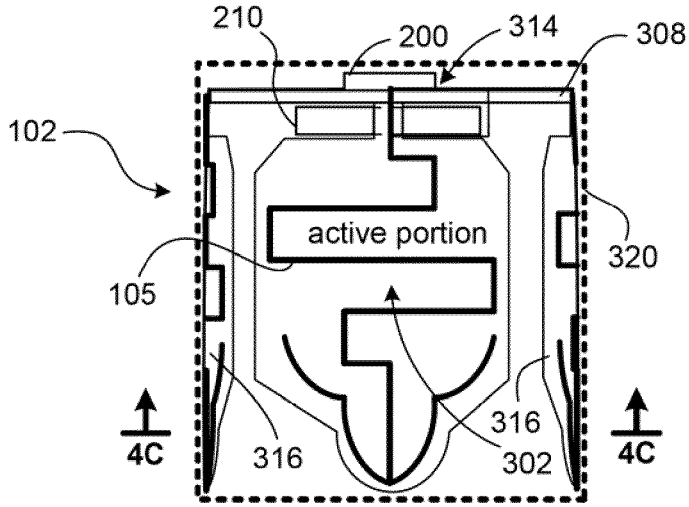
FIG. 4B is a side view of the RFID device in a housing according to one embodiment.

FIGS. 4A and 4B illustrate a top view and a side view, respectively, of an embodiment of an RFID device 102. Such embodiment, may be used with a rectangular or cylindrical housing 320. In FIG. 4A, four angled portions 316 extend from a base portion 312 in a coplanar configuration. As shown, the RFID device 102 includes an antenna 105 having a feed 306 coupled to the active portion 302. An RFID controller 200 is coupled to the feed 306. In operation, the controller 200 provides a signal to the feed 306, which excites the active portion 302, thereby generating an RF signal.

Figure 4C:
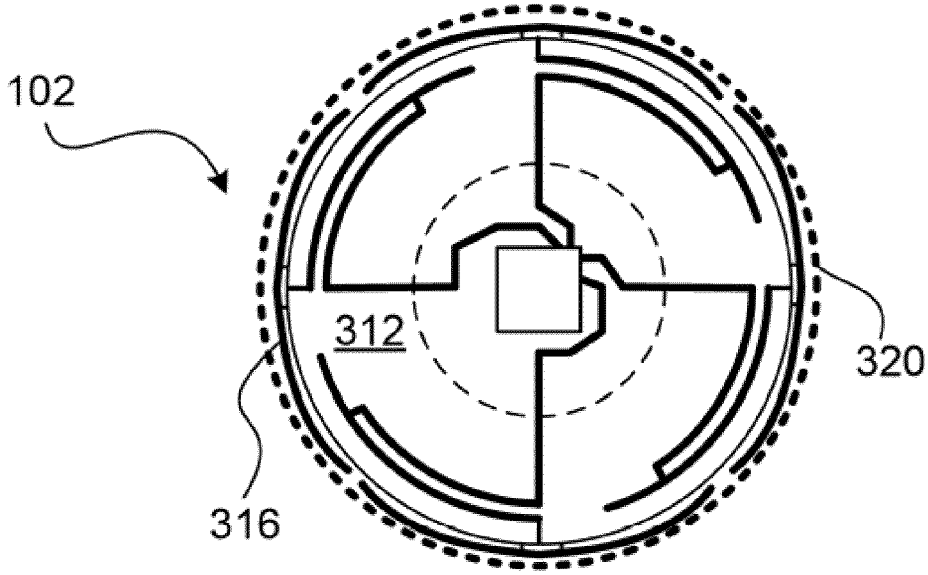
FIG. 4C is a cross sectional view taken along Line 4C-4C of FIG. 4B.

In this embodiment, the four angled portions 316 are flexible so that they can conform to the inside of a housing 320 as shown in FIG. 4B, in this example, a cylindrical housing. See FIG. 4C. Also, in this or any embodiment, the angled portions may be able to hold the folded shape without the aid of the housing 320. In FIG. 4B, the four angled portions 316 are shown folded at an angle of between about 1 degree and about 179 degrees to minimize the form factor of the RFID antenna. Also, in this embodiment, or any other, the housing may enclose the RFID device on every side, or it may enclose the RFID device on less than all sides, such as to allow access to the device. For example, in FIG. 4B, the cylindrical housing may be open on the top, bottom, or on both sides of the device, resulting in a housing that is shaped like a hollow tube.

In another embodiment, there may be two, four, or six angled portions 316 of the substrate 308, with an antenna having traces present on each of the angled portions 316. Also, an RFID chip 200 may be coupled to the antenna 105, along with an interface for connection to a battery 210 or some other power source. Also, at least one of the angled portions 316 may have a planar configuration.

In another embodiment, the angled portion is oriented at an angle of between about 45 degrees and about 135 degrees from a plane of the base portion 312. In a further embodiment, the angled portion is oriented at an angle of between about 75 degrees and about 105 degrees from a plane of the base portion 312. In yet another embodiment, the angled portion is oriented at an angle of between about 85 degrees and about 95 degrees from a plane of the base portion 312.

In yet another embodiment, a profile of the substrate 308 has a width taken from any angle of less than about 4 inches, less than about 3 inches, less than about 2 inches, less than about 1 inch, etc.

In a further embodiment, a portion of the active portion 302 of the antenna may be on the base portion 312 of the substrate 308.

Figure 5:
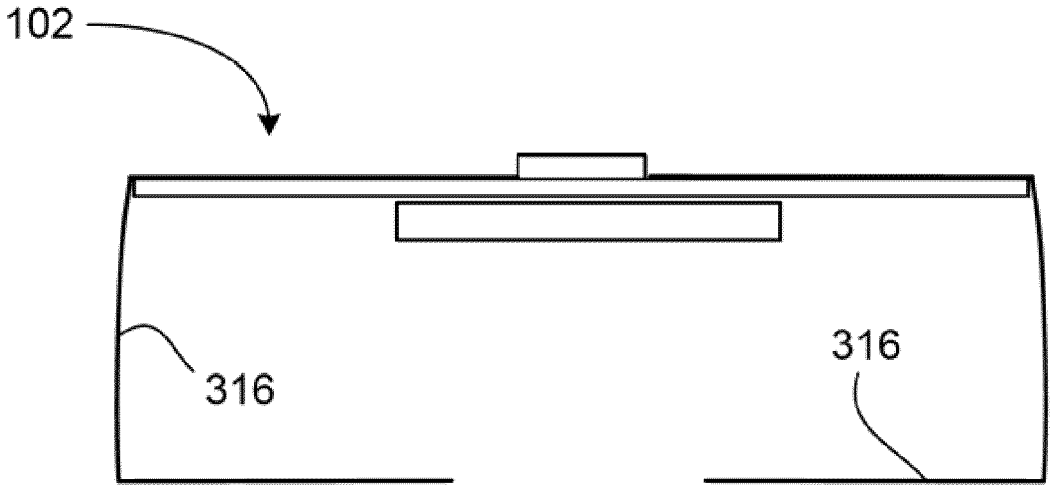
FIG. 5 is a cross-sectional view of the RFID device according to one embodiment.
Figure 6:
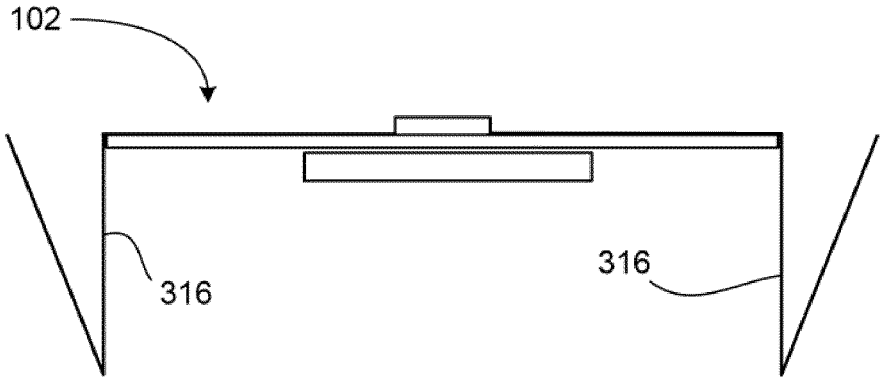
FIG. 6 is a cross-sectional view of an RFID device according to one embodiment.
Figure 7:
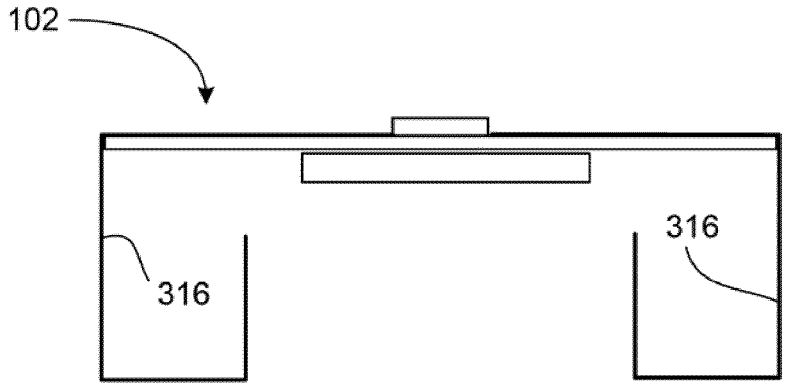
FIG. 7 is a cross-sectional view of an RFID device according to one embodiment.
Figure 8:
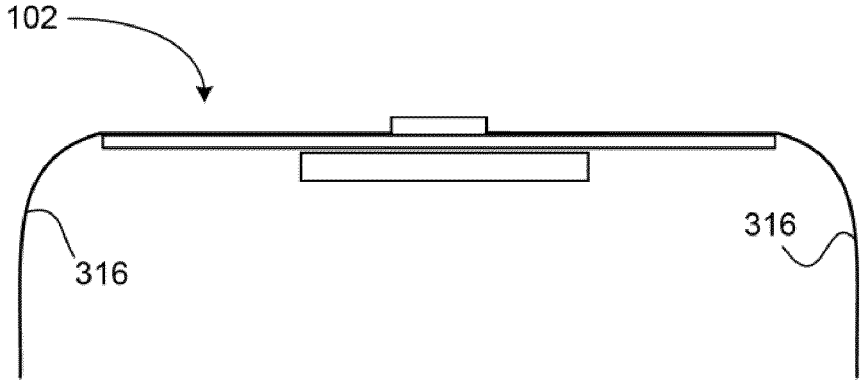
FIG. 8 is a cross-sectional view of an RFID device according to one embodiment.

In another embodiment, a portion of the angled portion 316 has at least one bend at a location away from a junction of the angled portion 316 and the base portion 312. Thus, a profile of the angled portion 316 might have an "L" shape (FIG. 5), a "U" shape (FIG. 7), a "V" shape (FIG. 6), a "C" shape, an accordion-like shape (e.g., an "N" shape), etc. Further, the bend in the angled portion 316 may give it a curved or arcuate shape. See, e.g., FIG. 8.

With reference to FIG. 3B, in another embodiment, a method of fabricating a Radio Frequency Identification (RFID) system comprises inserting a substrate 308 and antenna 105 into a housing 320, the substrate 308 having a base portion 312 and at least one angled portion 316, the antenna 105 being positioned, at least in part, on the at least one angled portion 316, wherein insertion of the substrate 308 and antenna 105 into the housing 320 causes the at least one angled portion 316 to become oriented at an angle of between about 5 degrees and about 175 degrees from a plane of the base portion 312.

In another embodiment, the angled portion is oriented at an angle of between about 45 degrees and about 135 degrees from a plane of the base portion 312. In a further embodiment, the angled portion is oriented at an angle of between about 75 degrees and about 105 degrees from a plane of the base portion 312. In yet another embodiment, the angled portion is oriented at an angle of between about 85 degrees and about 95 degrees from a plane of the base portion 312.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An antenna system for a Radio Frequency Identification (RFID) tag, the system comprising:

a base portion;

multiple angled portions each oriented to have a tangential angle of between about 5 degrees and about 175 degrees from a plane of the base portion; and antenna traces extending from the base portion onto each of the angled portions, the antenna traces being usable in RFID communications, wherein each angled portion has a free end positioned along an edge thereof opposite from the base portion, wherein each antenna trace on the angled portion associated therewith has a serpentine shape with several bends along its length, wherein each antenna trace on the associated angled portion has several first sections that extend parallel to a bend located at an interface of the angled portion and the base portion;

wherein each antenna trace on the associated angled portion has several second sections that extend between the first sections;

wherein at least one of the antenna traces on the base portion has a serpentine shape with several bends along its length, and further comprising a housing having a peripheral sidewall defining an interior therein, base portion and angled portions being inserted in the interior, the sidewall holding the angled portions at the orientation relative to the plane of the base portion, the housing preventing movement of the at least one of the angled portions from the orientation.

2. The system of claim 1, wherein at least two angled portions are present, an antenna trace being present on each of the angled portions, wherein the antenna traces are configured for backscatter RFID communications.

3. The system of claim 1, wherein the antenna trace is part of a dipole antenna, wherein an antenna trace is present on each of the angled portions, each of the antenna traces having a free terminal end thereof on the associated angled portion.

4. The system of claim 1, wherein the antenna trace is part of a dual dipole antenna, wherein at least four angled portions are present, an antenna trace being present on each of the angled portions.

5. The system of claim 1, wherein each of the angled portions is oriented at an overall angle of between about 75 degrees and about 105 degrees from the plane of the base portion.

6. The system of claim 1, wherein a profile of a substrate having the base portion and the angled portions has a maximum width of less than about 3 inches.

7. The system of claim 1, wherein a profile of a substrate having the base portion and the angled portions has a maximum width of less than about 2 inches.

8. The system of claim 1, wherein a profile of a substrate having the base portion and the angled portions has a maximum width of less than about 1 inch.

9. The system of claim 1, wherein the antenna traces are part of a dipole antenna, wherein a portion of each antenna trace capable of actively backscattering or transmitting and receiving is also present on the base portion.

10. The system of claim 1, wherein each of the angled portions has a generally planar configuration, wherein a plane of each of the angled portions is oriented at the angle of between about 5 degrees and about 175 degrees from the plane of the base portion, wherein the sections of the antenna trace in each of the angled portions lie in the plane of the associated angled portion, wherein the antenna traces are configured for backscatter RFID communications.

11. The system of claim 1, wherein at least one of the angled portions has at least one bend at a location thereon that is away from a junction of the at least one of the angled portions and the base portion, the antenna trace extending across the bend.

12. A Radio Frequency Identification (RFID) system, the system comprising:

an RFID chip configured for backscatter communication;

a base portion;

four angled portions each oriented to have a tangential angle of between about 1 degree and about 179 degrees from a plane of the base portion; and a dual dipole antenna having traces on each of the angled portions, the traces being in electrical communication with the RFID chip, wherein each angled portion has a free end positioned along an edge thereof opposite from the base portion, wherein each antenna trace on the angled portion associated therewith has a serpentine shape with several bends along its length, wherein each antenna trace on the associated angled portion has several first sections that extend parallel to a bend located at an interface of the angled portion and the base portion;

wherein each antenna trace on the associated angled portion has several second sections that extend between the first sections;

wherein at least one of the antenna traces on the base portion has a serpentine shape with several bends along its length; and further comprising a housing having a peripheral sidewall defining an interior therein, base portion and angled portions being inserted in the interior the sidewall holding the angled portions at the orientation relative to the plane of the base portion, the housing preventing movement of the angled portions from the orientation.

13. The system of claim 12, further comprising an interface for connection to a battery.

14. The system of claim 12, wherein the angled portions are each oriented at an angle of between about 75 degrees and about 105 degrees from the plane of the base portion.

15. The system of claim 13, wherein a profile of a substrate having the base portion and each of the angled portions has a maximum width of less than about 3 inches.

16. The system of claim 12, wherein a profile of a substrate having the base portion and the angled portions has a maximum width of less than about 2 inches.

17. The system of claim 12, wherein a profile of a substrate having the base portion and the angled portions has a maximum width of less than about 1 inch.

18. The system of claim 12, wherein portions of the antenna capable of actively backscattering are also present on the base portion.

19. The system of claim 12, wherein each of the angled portions has a planar configuration.

20. The system of claim 12, wherein at least one of the angled portions has at least one bend at a location thereon that is away from a junction of the at least one of the angled portions and the base portion, the antenna trace extending across the bend.

21. A Radio Frequency Identification (RFID) system, comprising:

an RFID chip configured for backscatter communication;

a base portion;

four angled portions each oriented to have a tangential angle of between about 1 degree and about 179 degrees from a plane of the base portion; and a dual dipole antenna having traces on each of the angled portions, the traces being in electrical communication with the RFID chip, wherein each angled portion has a free end positioned along an edge thereof opposite from the base portion, wherein each antenna trace on the angled portion associated therewith has a serpentine shape with several bends along its length, wherein each antenna trace on the associated angled portion has several first sections that extend parallel to a bend located at an interface of the angled portion and the base portion;

wherein each antenna trace on the associated angled portion has several second sections that extend between the first sections;

wherein at least one of the antenna traces on the base portion has a serpentine shape with several bends along its length; and further comprising a housing having a generally cylindrical portion that has a central axis oriented in an interior of the housing and about perpendicular to the base portion, wherein the angled portions are positioned in the interior of the housing wherein outer sides of the angled portions generally conform to and extend along a rounded shape of the generally cylindrical portion.

22. A method of fabricating a Radio Frequency Identification (RFID) system, the method comprising:

inserting a substrate and antenna in an interior of a housing, the substrate having a base portion and multiple angled portions, the antenna being positioned, at least in part, on the angled portions, wherein insertion of the substrate and antenna in the interior of the housing causes the angled portions to each become oriented to have a tangential angle of between about 5 degrees and about 175 degrees from a plane of the base portion, wherein each angled portion has a free end positioned along an edge thereof opposite from the base portion, wherein each antenna trace on the angled portion associated therewith has a serpentine shape with several bends along its length, wherein each antenna trace on the associated angled portion has several first sections that extend parallel to a bend located at an interface of the angled portion and the base portion;

wherein each antenna trace on the associated angled portion has several second sections that extend between the first sections;

wherein at least one of the antenna traces on the base portion has a serpentine shape with several bends along its length.

23. The method of claim 22, further comprising coupling an RFID chip configured for backscatter communication to traces extending along the angled portions, wherein a plane of each of the angled portions is oriented at an angle of between about 5 degrees and about 175 degrees from the plane of the base portion when inserted in the housing, wherein the sections of the antenna trace in each of the angled portions lie in the plane of the associated angled portion.

24. An antenna system for a Radio Frequency Identification (RFID) tag, the system comprising:

a base portion;

at least one angled portion having at least two sections each oriented to have a tangential angle of between about 1 degree and about 179 degrees from a plane of the base portion, the two sections having different overall angles relative to the base portion;

an antenna trace on the at least one angled portion, the trace extending along both sections of the at least one angled portion; and a housing having a peripheral sidewall defining an interior therein, the base portion and angled portions being inserted in the interior, the sidewall holding the angled portions at the orientation relative to the plane of the base portion.

25. The system of claim 24, wherein each angled portion has a free end positioned along an edge thereof opposite from the base portion, wherein each antenna trace on the angled portion associated therewith has a serpentine shape with several bends along its length, wherein each antenna trace on the associated angled portion has several first sections that extend parallel to a bend located at an interface of the angled portion and the base portion; wherein each antenna trace on the associated angled portion has several second sections that extend between the first sections; wherein at least one of the antenna traces on the base portion has a serpentine shape with several bends along its length.

* * * * *

UNITED STATES PATENT AND TRADEMARK OFFICE

CERTIFICATE OF CORRECTION

PATENT NO. : 8,217,849 B2
APPLICATION NO. : 12/098960
DATED : July 10, 2012
INVENTOR(S) : Sardariani et al.

It is certified that error appears in the above-identified patent and that said Letters Patent is hereby corrected as shown below:

col. 4, line 38, replace “backscaLtered” with --backscattered--.

Signed and Sealed this
Fourth Day of September, 2012

David J. Kappos

David J. Kappos
*Director of the United States Patent and Trademark Office*